United States Patent [19]

Nakajima

[11] Patent Number: 4,777,973

[45] Date of Patent: Oct. 18, 1988

[54] ALTERNATE WALKER HAVING EXTENSIBLE/CONTRACTIBLE FRONT AND REAR LEGS

[76] Inventor: Kotaro Nakajima, 2-8 Toyosaki, 7-chome, Oyodo-ku, Osaka, Japan

[21] Appl. No.: 78,357

[22] Filed: Jul. 28, 1987

[30] Foreign Application Priority Data

Apr. 28, 1987 [JP] Japan ..... 62-64432[U]

[51] Int. Cl.[4] ..... A61H 3/00

[52] U.S. Cl. ..... 135/67; 272/70; 297/5

[58] Field of Search ..... 135/67; 272/70.2, 70.3, 272/70.4; 297/4, 5, 6, 7

[56] References Cited

U.S. PATENT DOCUMENTS

| | | | |
|---|---|---|---|
| Re. 29,574 | 3/1978 | Pethick | 446/490 |
| 3,169,344 | 2/1965 | Greene | 446/314 |
| 3,176,700 | 4/1965 | Drury, Jr. | 135/67 |
| 3,455,313 | 7/1969 | King | 135/67 |
| 3,800,815 | 4/1974 | Birk | 135/67 |

*Primary Examiner*—Robert A. Hafer

*Assistant Examiner*—Charles H. Sam

*Attorney, Agent, or Firm*—Frank J. Jordan; C. Bruce Hamburg; Manabu Kanesaka

[57] ABSTRACT

Disclosed is an alternate walker having extensible/contractible front and rear legs which comprises: a pair of reverse U-shaped frame pipes connected to each other in parallel through cross bar means; a pair of front legs slidably partly inserted into front lower ends of the pair of frame pipes respectively; a pair of rear legs slidably partly inserted into rear lower ends of the pair of frame pipes respectively; a train of serially connected substantially spherical bodies slidably inserted within each of the pair of frame pipes, the substantially spherical bodies in train being connected by a wire which is passed through the substantially spherical bodies in series and which is connected at its opposite ends to the front and rear legs respectively in each of the pair of frame pipes; and a pair of control means provided on the pair of frame pipes respectively for controlling sliding movement of the train of serially connected substantially spherical bodies within each of the pair of frame pipes.

7 Claims, 4 Drawing Sheets

ALTERNATE WALKER HAVING EXTENSIBLE/CONTRACTIBLE FRONT AND REAR LEGS

BACKGROUND OF THE INVENTION

1. Field of the Invention

The present invention relates to alternate walkers for persons who require walking assistant means, for example, such as handicapped persons, aged persons, wounded persons, etc., and particularly relates to a 4-point supported alternate walker having four legs for alternate walking.

2. Description of the Prior Art

A 4-point supported alternate walker having four supporting legs has been known and used for a person who requires walking assistant means. Such a 4-point supported alternate walker is superior in stability and safety, and gives little fatigue to a user. Accordingly, there are many persons in Europe and America who use such walkers habitually.

However, such a walker has a serious defect in that it can not be used in a place where a user feels uneasy, for example, in ascending/descending stairs, in getting in/-off various transportations, and so on.

Accordingly, studies had been performed to elimnate such a defect, and in America, in fact, developed was a walker in which front and rear legs were made extensible by use of an oil pressure mechanism and the positions of the legs were controlled through an operation of a valve disposed at an intermediate position. Such a walker using an oil pressure mechanism was welcomed for a time, but is now stopped from manufacturing because of functional troubles, oil leakage, heavy weight, high cost, etc.

SUMMARY OF THE INVENTION

An object of the present invention is to eliminate the disadvantages in the prior art as described above.

Another object of the present invention is to provide an alternate walker having a lot of advantages as described later.

In order to attain the above objects, according to the present invention, the alternate walker having extensible/contractible front and rear legs comprises: a pair of reverse U-shaped frame pipes connected to each other in parallel through cross bar means; a pair of front legs slidably partly inserted into front lower ends of the pair of frame pipes respectively; a pair of rear legs slidably partly inserted into rear lower ends of the pair of frame pipes respectively; a train of serially connected substantially spherical bodies slidably inserted within each of the pair of frame pipes, the substantially spherical bodies in train being connected by a wire which is passed through the substantially spherical bodies in series and which is connected at its opposite ends to the front and rear legs respectively in each of the pair of frame pipes; and a pair of control means provided on the pair of frame pipes respectively for controlling sliding movement of the train of serially connected substantially spherical bodies within each of the pair of frame pipes.

BRIEF DESCRIPTION OF THE DRAWINGS

Other objects and advantages of the invention will become apparent during the following discussion of the accompanying drawings, wherein.

DETAILED DESCRIPTION OF PREFERRED EMBODIMENT

Figure 1:
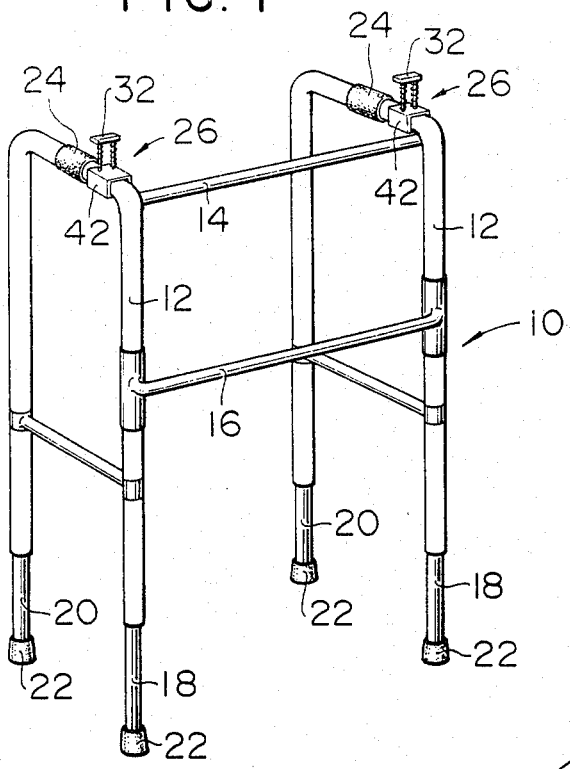
FIG. 1 is a perspective view of an alternate walker according to the present invention.

Referring to the drawings, an embodiment of the alternate walker having extensible/contractible front and rear legs according to the present invention will be described hereunder.

As shown in FIG. 1, an alternate walker designated generally by a reference numeral 10 is constituted by a pair of reverse U-shaped frame pipes 12 (hereinafter simply referred to "frame pipes"), cross bar pipes 14 and 16 for connecting and holding the frame pipes 12, a pair of front legs 18 partly slidably inserted into the respective front lower ends of the frame pipes 12, a pair of rear legs 20 partly slidably inserted into the respective rear lower ends of the frame pipes 12 respectively, bottom caps 22 inserted on the bottom ends of all the front and rear legs respectively, a pair of grips 24 provided on the frame pipes 12 respectively, and a pair of mechanisms 26 attached on the frame pipes respectively for controlling the extension/contraction of the front and rear legs 18 and 20. The frame pipes 12, the cross bar pipes 14 and 16, and the front and rear legs 18 and 20 may be made of a suitable light and rigid material such as an aluminum alloy, ceramics, or the like, and the grips and the bottom caps may be made of a suitable material such as rubber, synthetic resin, or the like.

Figure 2:
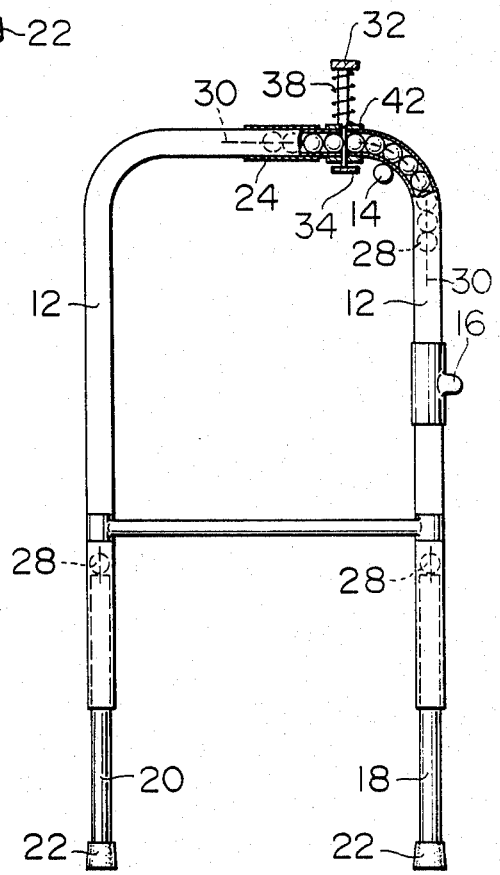
FIG. 2 is a side view partly in section of the alternate walker for explaining the relation between the train of spherical bodies disposed inside the reverse U-shaped frame pipe for connecting the front and rear legs and the movement control mechanism disposed on the frame pipe for controlling the movement of the train of spherical bodies.

FIG. 2 illustrates one of the pair of frame pipes 12. The front leg 18 and the rear leg 20 are connected through a train of spherical bodies 28 slidably inserted in the hollow of the frame pipe 12. That is, numbers of spherical bodies 28 are connected in series by means of a wire 30 passed through center holes formed in the respective spherical bodies 28, and the wire 30 is connected at its opposite ends to the front and rear legs 18 and 20 respectively. Each of the spherical bodies 28 has an outer diameter slightly smaller than the inner diameter of the frame pipe 12 so that the train of spherical bodies 8 are slidably movable in the hollow of the frame pipe 12 to thereby lengthen and shorten the front and rear legs 18 and 20 respectively, or vice versa. The spherical bodies 28 may be made of a material which is not only sufficiently rigid so as not to be easily deformed or broken but sufficiently light in weight, for example, polyamide resin, wood such as box-wood, or hard ceramics. The shape of the spherical body 28 is not always limited to a real sphere body but may be other body of revolution such as an ellipsoid of revolution so long as it can smoothly slide in the hollow of the frame pipe.

Figure 3:
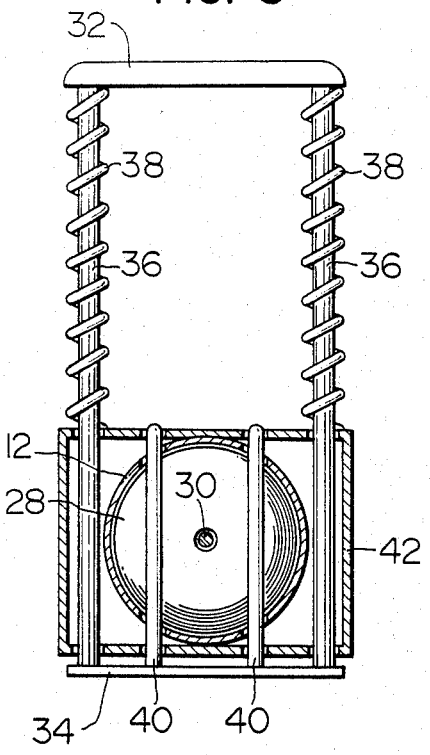
FIG. 3 is an enlarged front view partly in section of a main part of the movement control mechanism in its normal position.
Figure 4:
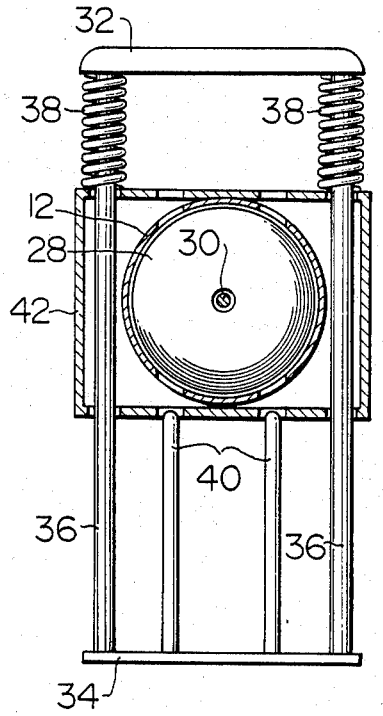
FIG. 4 is an enlarged front view partly in section of the main part of the movement control mechanism in its depressed position.
Figure 5:
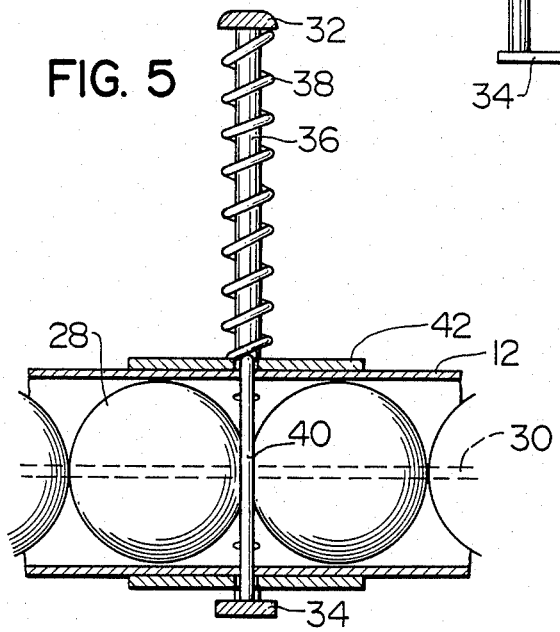
FIG. 5 is an enlarged side view partly in section of the main part of the movement control mechanism in its normal position.
Figure 6:
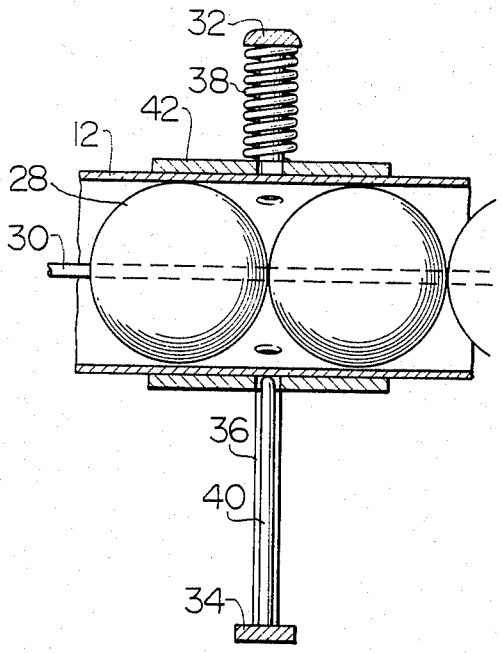
FIG. 6 is an enlarged side view partly in section of the main part of the movement control mechanism in its depressed position.
Figure 7:
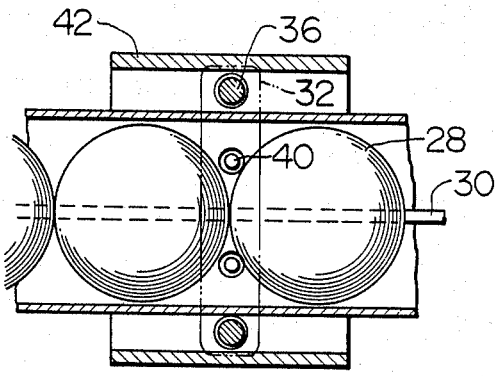
FIG. 7 is an enlarged top view partly in section of the main part of the movement control mechanism.

Referring to FIGS. 3 through 7, the mechanism for lengthening/shortening the front and rear legs and the mechanism for controlling the extension/contraction of the front and rear legs will be more specifically described hereunder. The wire 30 is connected at its both ends respectively to the front and rear legs 18 and 20 which are slidably inserted by about a half length into the opposite lower end portions of the frame pipe 15, so that the front leg, the train of spherical bodies, and the rear leg are integrated with each other into one body. Being connected and interlocked with each other through the train of spherical bodies 28, the front leg 18 and the rear leg 20 are slidable in the frame pipe 12 so as to be complementarily lengthened and shortened respectively, and vice versa. The mechanism 26 for controlling the extension/contraction of the front and rear legs 18 and 20 is arranged so as to normally prevent the movement of the train of spherical bodies 28 in the frame pipe 12 but the mechanism 26 can allow the train of spherical bodies 28 to move in the frame pipe 12. That is, the mechanism 26 is constituted by a pressing plate 32, a stand plate 34, a pair of sliding guide poles 36, a pair of herical compression springs 38, a pair of movement-control pins 40, and a sliding-guide enclosure 42 for guiding sliding of the sliding guide poles 36 and the movement-control pins 40. The sliding-guide enclosure 42 is constituted, for example, by four plates and fixed to the frame pipe 12, for example, by welding, or any other suitable means. The pair of sliding guide poles 36 and the pair of movement-control pins 40 are fittingly slidably passed through holes formed in the sliding-guide enclosure 42 and the frame pipe 12 at suitable positions. The pressing plate 32 and the stand plate 34 are disposed in opposition to each other and the pair of sliding guide poles 36 are fixedly connected at their opposite ends to the pressing plate 32 and the stand plate 34 respectively so as to extend therebetween to form a frame as a whole. The pair of movement-control pins 40 are fixedly attached at their one ends on the stand plate 34. The pair of herical compression springs 38 are mounted on the pair of sliding guide poles 36 respectively between the pressing plate 32 and the sliding guide enclosure 42 so as to urge the pressing plate 32 upward so that the movement-control pins 40 are caused to pass through a space between adjacent two spherical bodies 28 through the frame plate 12 to penetrate the upper plate portion of the sliding-guide enclosure 42, as illustrated in FIG. 3. Thus, the train of spherical bodies 28 are normally prevented from moving in the frame pipe 12 so that the respective lengths of the front and rear legs 18 and 20 are fixedly maintained. If the pressing plate 32 is manually pressed down by a user against the spring force of the herical compression springs 38, the movement-control pins 40 are lowered together with the sliding guide poles 36 and the stand plate 34 as illustrated in FIG. 4 so as to allow the train of spherical bodies 28 to freely move in the frame pipe 12 so that the respective lengths of the front and rear legs 18 and 20 can be desiredly complementarily lengthened and shortened, and vice versa.

Figure 8:
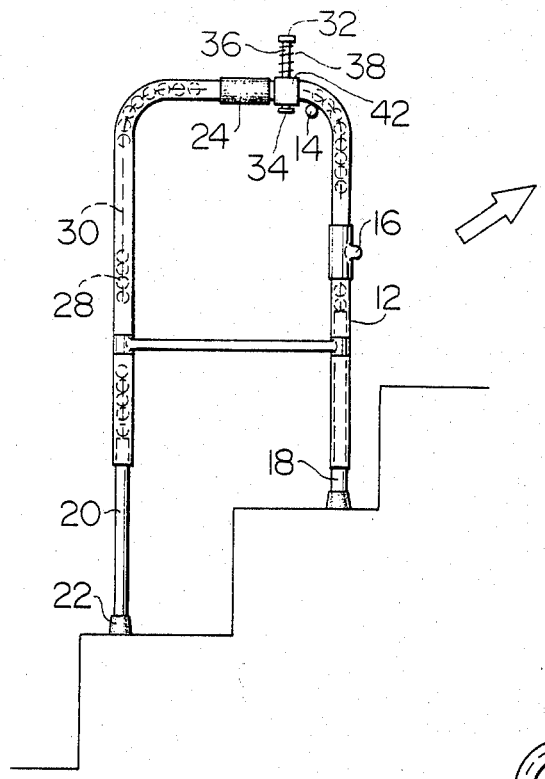
FIG. 8 is a side view partly in section showing the walker in ascending stairs.
Figure 9:
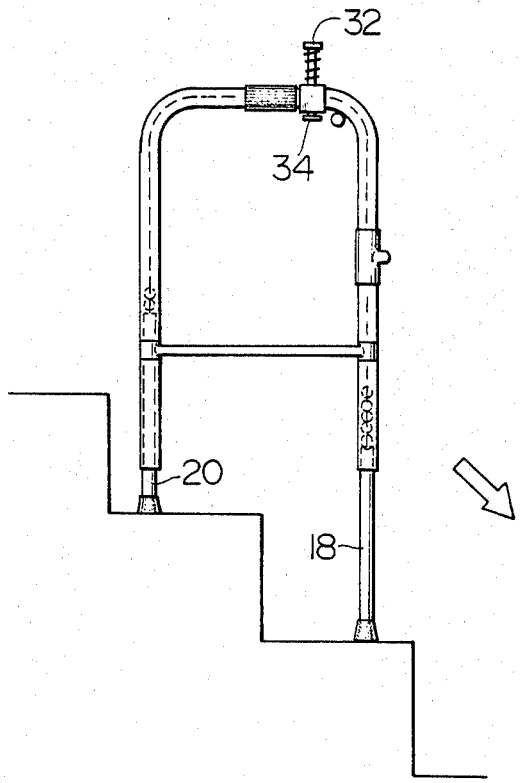
FIG. 9 is a side view partly in section showing the walker in descending stairs.

When the user of the walker starts to walk, the left and right pressing plates 32 are pressed down by the user against the spring force of the herical compression springs 38 so as to adjust the respective lengths of the front and rear legs 18 and 20 at the left and right sides, and then the left and right pressing plates 32 are released so that the respective lengths of the front and rear legs 18 and 20 are fixed. For the walk on a level land, the lengths of the front and rear legs 18 and 20 will be made even. However, when the user wishes to ascend or descend stairs or the like, as a matter of course, the left and right front legs 18 are changed in length from the left and right rear legs 20 as shown in FIGS. 8 and 9. Assume now that the user wishes to ascend stairs. First, in order to shorten the left and right front legs 18 as shown in FIG. 8, the user presses the left and right pressing plates 32 down by his left and right thumbs to release the fixity of the train of spherical bodies 28, and at the same time presses the front side of the frame pipe 12 against the step of the stairs so that the left and right front legs 18 are pressed upward by the step of the stairs to cause them to come into the frame pipe 12 to shorten their lengths. The pressure applied to the left and right front legs 18 are successively dynamically transmitted to the connected spherical bodies 28 so that the left and right rear legs 20 are pushed outward to be lengthen by the same lengths as those of retraction of the left and right front legs 18. As soon as suitable contraction and extension of the respective front and rear legs 18 and 20 are obtained, the user releases his left and right thumbs from the left and right pressing plates 32 so as to make the mechanism 26 come back to its normal state owing to the herical compression springs 38 so that the front and rear legs are firmly fixed.

Similarly to this, when the user wishes to descend stairs, the user operates the left and right pressing plates 32 so that the rear legs 20 are retracted while the front legs 18 are extended correspondingly as shown in FIG. 9 and then both the front and rear legs 18 and 20 are fixed.

The user can recognize the fixity of the front and rear legs 18 and 20 by externally visually inspecting the left and right pressing plates 32 whether they have returned to their normal or initial positions.

The effects of the present invention are as follows:

(a) The walker according to the present invention provides the same effects as those of the conventional walker in properties such as stability, safety, and in that little fatigue is given to a user;

(b) If the walker is made foldable in a known manner although the folding mechanism is not illustrated in the drawings, the walker can be made to be not thicker than about 10 cm in a folded state out of use, so that the user can easily carry about the walker in the folded state;

(c) The weight of the walker is almost the same as the conventional walker;

(d) The walker is simple in structure, has no functional trouble, and can be manufactured inexpensively;

(e) The walker is superior in stability and safety in ascending and descending stairs, in getting on and off means of transportation, and so on, where a person who most needs an alternate walker and feels uneasy, and therefore the user of the walker does not need to depend on others in such a situation, so that as a matter of course the user's region of action is expanded and the limit in the conventional walker is eliminated; and (f) The user of the walker can immediately freely cope with any change in conditions in walking with a simple operation.

What is claimed is:

1. An alternate walker, comprising:

a pair of reverse U-shaped frame pipes situated parallel to each other, each frame pipe having front and rear lower portions, cross bar means connected to the respective frame pipes to connect the same together, a pair of front legs, each partly slidably inserted into the front lower portion of the frame pipe, a pair of rear legs, each partly slidably inserted into the rear lower portion of the frame pipe, a pair of connecting means, each connecting means being slidably situated inside the frame pipe to connect between the front and rear legs so that when one of the front and rear legs is moved, the other is moved in association therewith, each connecting means including a plurality of substantially spherical bodies arranged in series to allow the adjacent spherical bodies to pivot relative to each other, a pair of control means attached to the frame pipes respectively, each control means including a pressing member, at least one guide member connected to the pressing member to allow the pressing member to move relative to the frame pipe, two control pins connected to the guide member to extend toward the pressing member, at least one spring device situated between the pressing member and the frame pipe to urge the pressing member to move away from the frame pipe, and four holes formed in the frame pipe to permit the control pins to enter thereinto so that when the two control pins are located in the holes, the control pins are situated between the adjacent two spherical bodies to thereby prohibit movement of the front and rear legs relative to the frame pipe, and when the pressing member is pushed relative to the frame pipe against force of the spring, the control pins move away from the holes to thereby permit movement of the front and rear legs relative to the frame pipe.

2. An alternate walker according to claim 1, in which each connecting means further includes a wire, said spherical bodies having through holes therein so that the wire passes through the through holes to form series of spherical bodies.

3. An alternate walker according to claim 2, in which each control means further includes a cover member connected to the frame pipe, an additional guide member connected to the pressing member parallel to the guide member, both guide members being slidably situated in the cover member, an additional spring device situated parallel the spring device, both spring devices being placed around the guide members respectively, and a stand plate connected to the guide members, said control pins being attached to the stand plate.

4. An alternate walker according to claim 1, in which each of said substantially spherical bodies is made of a material which is not only rigid so as not to be easily deformed or broken but light in weight.

5. An alternate walker according to claim 4, in which the material of said substantially spherical bodies is polyamide resin.

6. An alternate walker according to claim 4, in which the material of said substantially spherical bodies is hard wood.

7. An alternate walker according to claim 4, in which the material of said substantially spherical bodies is hard ceramics.

* * * * *